US009028266B2

(12) United States Patent
Shimizu et al.

(10) Patent No.: US 9,028,266 B2
(45) Date of Patent: May 12, 2015

(54) CONNECTOR DEVICE

(71) Applicant: Yazaki Corporation, Minato-ku, Tokyo (JP)

(72) Inventors: Tomohiko Shimizu, Makinohara (JP); Akinori Tashiro, Makinohara (JP); Akihiro Tsuruta, Fujieda (JP); Kazuya Terao, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/141,566

(22) Filed: Dec. 27, 2013

(65) Prior Publication Data

US 2014/0106585 A1 Apr. 17, 2014

Related U.S. Application Data

(63) Continuation of application No. PCT/JP2012/066673, filed on Jun. 29, 2012.

(30) Foreign Application Priority Data

Jul. 1, 2011 (JP) ..... 2011-147142

(51) Int. Cl.

| | |
|---|---|
| ***H01R 13/64*** | (2006.01) |
| ***H01R 13/74*** | (2006.01) |
| *H01R 13/516* | (2006.01) |
| *H01R 13/629* | (2006.01) |

(52) U.S. Cl.

CPC ..... *H01R 13/64* (2013.01); *H01R 13/516* (2013.01); *H01R 13/62938* (2013.01); *H01R 13/743* (2013.01)

(58) Field of Classification Search

CPC ..... H01R 13/62938; H01R 13/62933; H01R 13/62977; H01R 13/741; H01R 13/64; H01R 13/74

USPC ..... 439/310, 152, 157, 159–160, 350, 357, 439/372

See application file for complete search history.

(56) References Cited

U.S. PATENT DOCUMENTS 5,906,501 A * 5/1999 Longueville et al. ..... 439/327
7,637,757 B2 * 12/2009 Matsumura et al. ..... 439/157

(Continued)

FOREIGN PATENT DOCUMENTS

| | | | |
|---|---|---|---|
| JP | H08-115766 | A | 5/1996 |
| JP | 2002-359029 | A | 12/2002 |
| JP | 2003-282182 | A | 10/2003 |

OTHER PUBLICATIONS

Japanese office action letter issued on Jan. 20, 2015 in the counterpart Japanese patent application.

*Primary Examiner* — Edwin A. Leon

(74) *Attorney, Agent, or Firm* — Marvin A. Motsenbocker; Mots Law, PLLC

(57) ABSTRACT

A connector device is provided in which a fitting force acts on a female connector and a male connector by operating a lever from a fitting start operation position to a fitting end operation position. The connector device includes a semi-fitting detection portion and a pressing portion. The semi-fitting detection portion is located at a non-projecting position below a peripheral surface of a frame of the female connector and is shifted to a projecting position to project from the peripheral surface of the frame by a pressing force. The pressing portion is provided in the male connector, presses and shifts the semi-fitting detection portion to the projecting position when located at a fitting halfway position before a fitting end position, and stops pressing the semi-fitting detection portion when located at the fitting end position so as to shift the semi-fitting detection portion to the non-projecting position.

3 Claims, 14 Drawing Sheets

(56) References Cited

U.S. PATENT DOCUMENTS

2002/0178538 A1 12/2002 Matsushita
2003/0216072 A1* 11/2003 Kato et al. ..... 439/157
2007/0134958 A1* 6/2007 Noro et al. ..... 439/157

* cited by examiner

CONNECTOR DEVICE

CROSS REFERENCE TO RELATED APPLICATION

This is a continuation application based on PCT application No. PCT/JP2012/066673 filed on Jun. 29, 2012, which claims the benefit of priority from Japanese Patent Application No. 2011-147142 filed on Jul. 1, 2011, the entire contents of which are incorporated by reference herein.

BACKGROUND OF THE INVENTION

1. Field of the Invention

The present invention relates to a connector device capable of fitting two connectors together by operating a lever with a smaller force than a fitting force acting on the two connectors.

2. Description of the Related Art

There has been known such a connector device as shown in FIG. 1A to FIG. 3 (refer to Patent Literature 1: Japanese Patent Application Laid-Open Publication No. 2002-359029).

A connector 100 is composed of a first connector 101 and a second connector 120. As particularly shown in FIG. 1A, the first connector 101 includes a first connector housing (not shown in the figure), a frame 103 fixed to the first connector housing (not shown in the figure) and having a connector fitting chamber 103*a* inside thereof, and a lever 110 rotatably supported by the frame 103.

Plural terminals (not shown in the figure) are arranged in the first connector housing 102. The frame 103 is provided with a pair of pin clearance holes 104. The frame 103 is provided, at the rear end thereof, with a locking flange 105 projecting therefrom. The frame 103 is provided with panel locking portions 106 projecting from the peripheral surface of the frame 103. The panel locking portions 106 are elastically deformable to be placed below the peripheral surface when an external pressing force is applied thereto.

The lever 110 rotates about a rotation support 111 within a range from a fitting start operation position (the position shown in FIG. 2) to a fitting end operation position (the position shown in FIG. 3). The lever 110 is provided with a pair of cam grooves 112. The pair of cam grooves 112 are open at the same position as the pair of pin clearance holes 104 when the lever 110 is located at the fitting start operation position.

The second connector 120 includes a second connector housing 121 as particularly shown in FIG. 1B. Plural terminals (not shown in the figure) are arranged in the second connector housing 121. The second connector housing 121 is provided with a pair of cam pins 122 projecting therefrom.

In the above-described configuration, as shown in FIG. 3, in the state where the lever 110 is located at the fitting start operation position, the second connector 120 is inserted in the connector fitting chamber 103*a* of the first connector 101. The cam pins 122 are then inserted in entrances of the cam grooves 112 of the lever 110. The second connector 120 is thus set at a fitting start position.

Next, the lever 110 is rotated from the fitting start operation position toward a fitting end position. The cam pins 122 then move in the cam grooves 112 so as to gradually bring the second connector 120 into the connector fitting chamber 103*a* of the first connector 101 due to a fitting force acting on the second connector 120 and the first connector 101.

As shown in FIG. 3, when the lever 110 is rotated to the fitting end operation position, the second connector 120 is brought into the fitting end position so as to be in a completely fitted state. The corresponding terminals (not shown in the figure) are properly connected to each other at the fitting end position.

Subsequently, the connector device 100 in which the first connector 101 and the second connector 120 are fitted together is inserted into a mounting hole 131 of a mounting panel 130 from the frame 103 side. The panel locking portions 106 then come into contact with the peripheral edge of the mounting hole 131. By further applying the insertion force thereto, the panel locking portions 106 are elastically deformed inward so that the insertion of the frame 103 is allowed. Once the panel locking portions 106 completely pass through the mounting hole 131, the panel locking portions 106 are elastically deformed to return to the original state, and the locking flange 105 comes into contact with the mounting panel 130. The mounting panel 130 is interposed between the respective panel locking portions 106 and the locking flange 105 so that the connector device 100 is mounted to the mounting panel 130.

In this conventional example, the first connector 101 and the second connector 120 are preliminarily fitted together, and the connector device 100 in the fitted state is then inserted into the mounting hole 131 of the mounting panel 130 to be mounted to the mounting hole 131. Therefore, there is no need to ensure a working space for attaching the second connector 120 to the first connector 101 that has been mounted to the mounting panel 130, or for operating the lever 110. Thus, even in the case where no working space can be ensured, the connector device 100 can be mounted to the mounting hole 131.

Such a connector device 100 can be mounted to the mounting panel 130 even when the first connector 101 and the second connector 120 are in a semi-fitted state. However, when the connector device 100 in the semi-fitted state is mounted to the mounting panel 130, a defect in conduction may be caused. When the defect is caused, the connector device 100 is required to be once removed from the mounting panel 130 and reattached thereto after properly fitting the connectors together, which requires a lot of work. In view of this, it is desired to preliminarily detect a semi-fitted state between the first connector 101 and the second connector 120 before mounting the connector device 100 to the mounting panel 130.

SUMMARY OF THE INVENTION

The present invention has been accomplished in view of the above-described conventional problem. An object of the present invention is to provide a connector device capable of detecting a semi-fitted state between connectors.

In order to achieve the above-described object, an aspect of the present invention is to provide a connector device including: a first connector including a first connector housing provided with a first terminal therein, a frame fixed to the first connector housing and provided with a connector fitting guide portion, and a lever rotatably supported by the frame; a second connector including a second connector housing provided with a second terminal therein, the second connector housing being guided by the connector fitting guide portion so as to be fitted to the first connector, wherein a fitting force acts on the first connector and the second connector by operating the lever from a fitting start operation position to a fitting end operation position, the second connector moves from a fitting start position to a fitting end position, and the frame is inserted and mounted to a mounting hole of a mounting member in a state where the first connector and the second connector are fitted together; a semi-fitting detection portion which is located at a non-projecting position below a peripheral surface of the frame of the first connector and is shifted to a projecting position to project from the peripheral surface of the frame by a pressing force; and a semi-fitting operation portion which is provided in the second connector, presses and shifts the semi-fitting detection portion to the projecting position when located at a fitting halfway position before the fitting end position, and stops pressing the semi-fitting detection portion when located at the fitting end position so as to shift the semi-fitting detection portion to the non-projecting position.

The connector device preferably further includes: a lever pre-locking portion which is provided in the first connector, is located at a lever pre-locking position where the lever located at the fitting start operation position is prevented from moving, and is shifted, by a pressing force, to a lever pre-locking release position where the lever is allowed to move; and a lever pre-locking release portion which is provided in the second connector, and when set at the fitting start position, presses and shifts the lever pre-locking portion to the lever pre-locking release position, wherein the semi-fitting detection portion is attached to the lever pre-locking portion, and follows the lever pre-locking portion so as to be shifted to the non-projecting position when the lever pre-locking portion is located at the lever pre-locking position and shifted to the projecting position when the lever pre-locking portion is located at the lever pre-locking release position, and a pressing portion functions as both the semi-fitting operation portion and the lever pre-locking release portion.

The lever is preferably provided with a connector fitting front opening common to the frame in a state where the lever is located at the fitting start operation position.

According to the present invention, as described above, the semi-fitting detection portion projects from the peripheral surface of the frame when the first connector and the second connector are in the semi-fitted state. This does not allow the connector device to be mounted to the mounting member since the semi-fitting detection portion is in contact with the mounting member when the frame is inserted into the mounting hole of the mounting member. Due to such a configuration, the semi-fitted state between the connectors can be detected.

DESCRIPTION OF THE EMBODIMENTS

Hereinafter, an embodiment according to the present invention will be described with reference to the drawings.

Figure 1A:
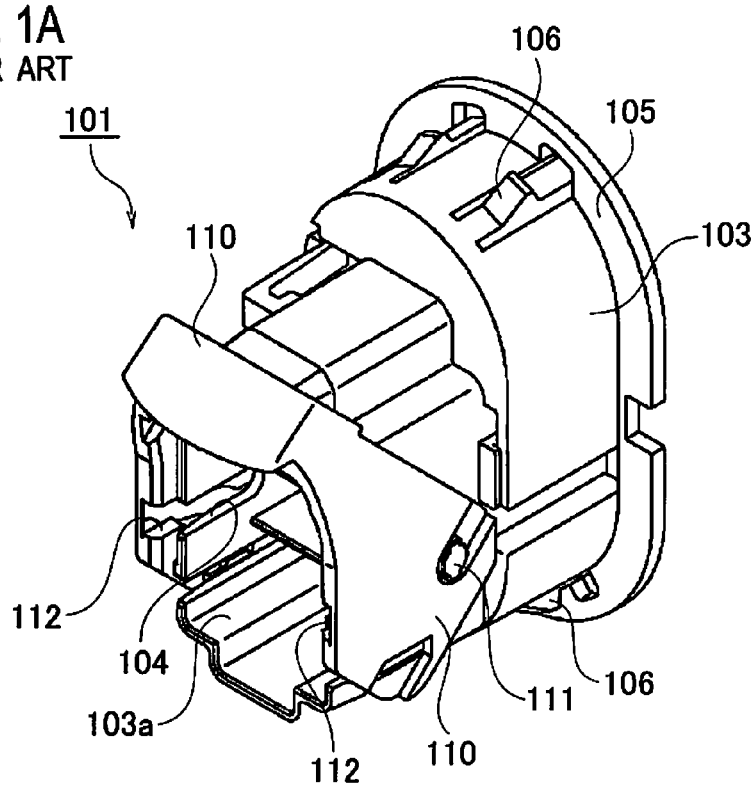
FIG. 1A PRIOR ART
FIG. 1A shows a conventional example and is a perspective view of a first connector.
Figure 1B:
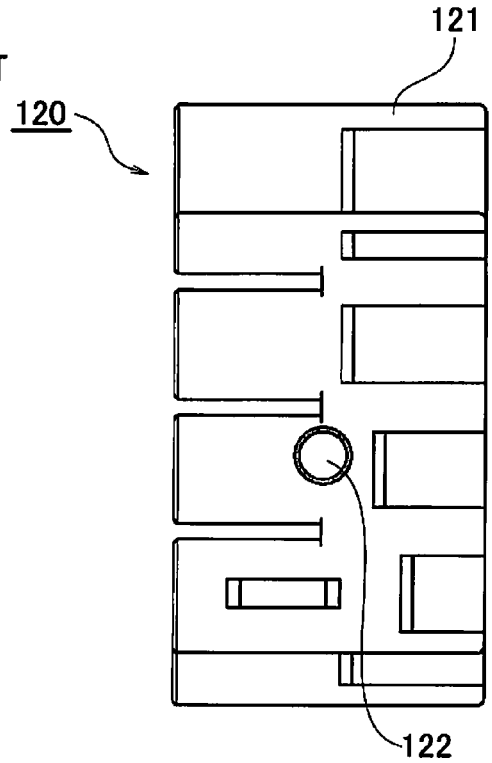
FIG. 1B PRIOR ART
FIG. 1B shows the conventional example and is a side view of a second connector.
Figure 2:
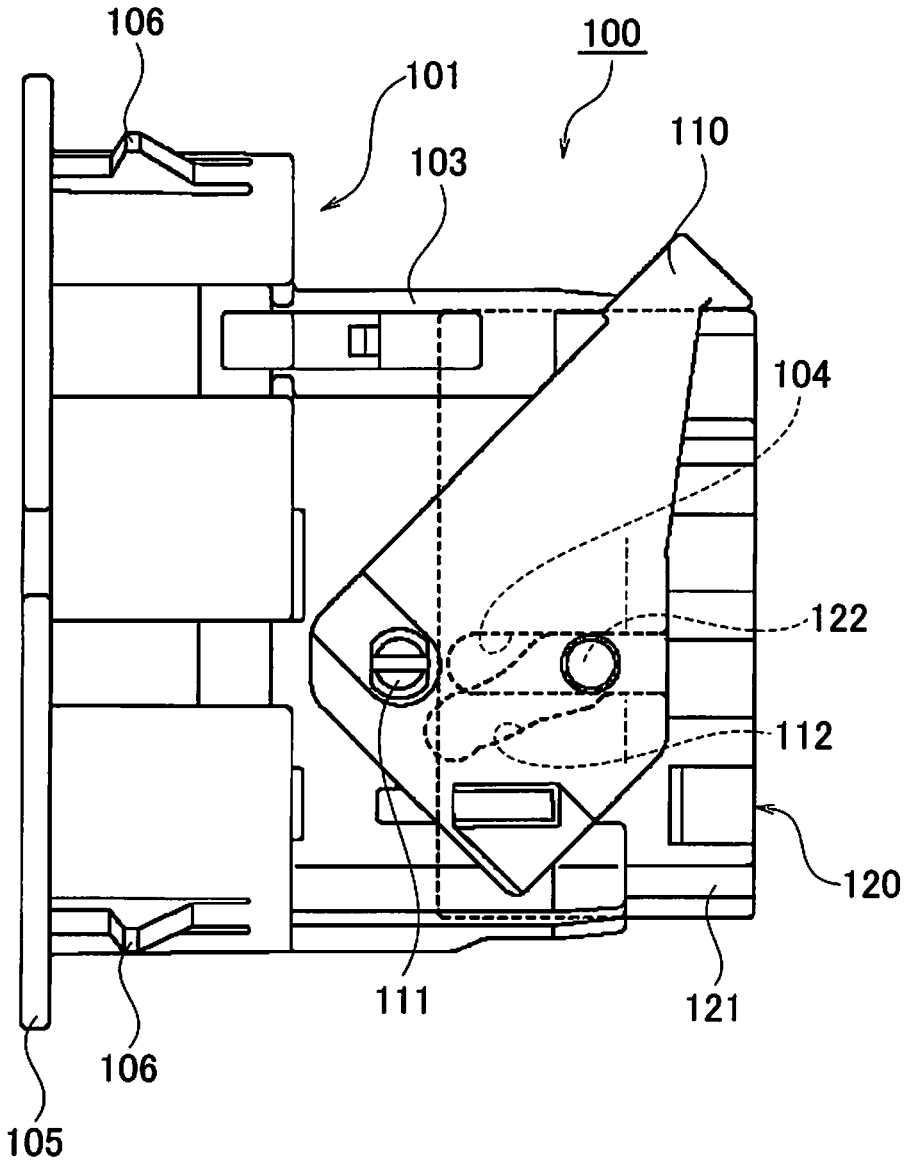
FIG. 2 PRIOR ART
FIG. 2 shows the conventional example and is a side view of a state where the first connector and the second connector are set at a fitting start position.
Figure 3:
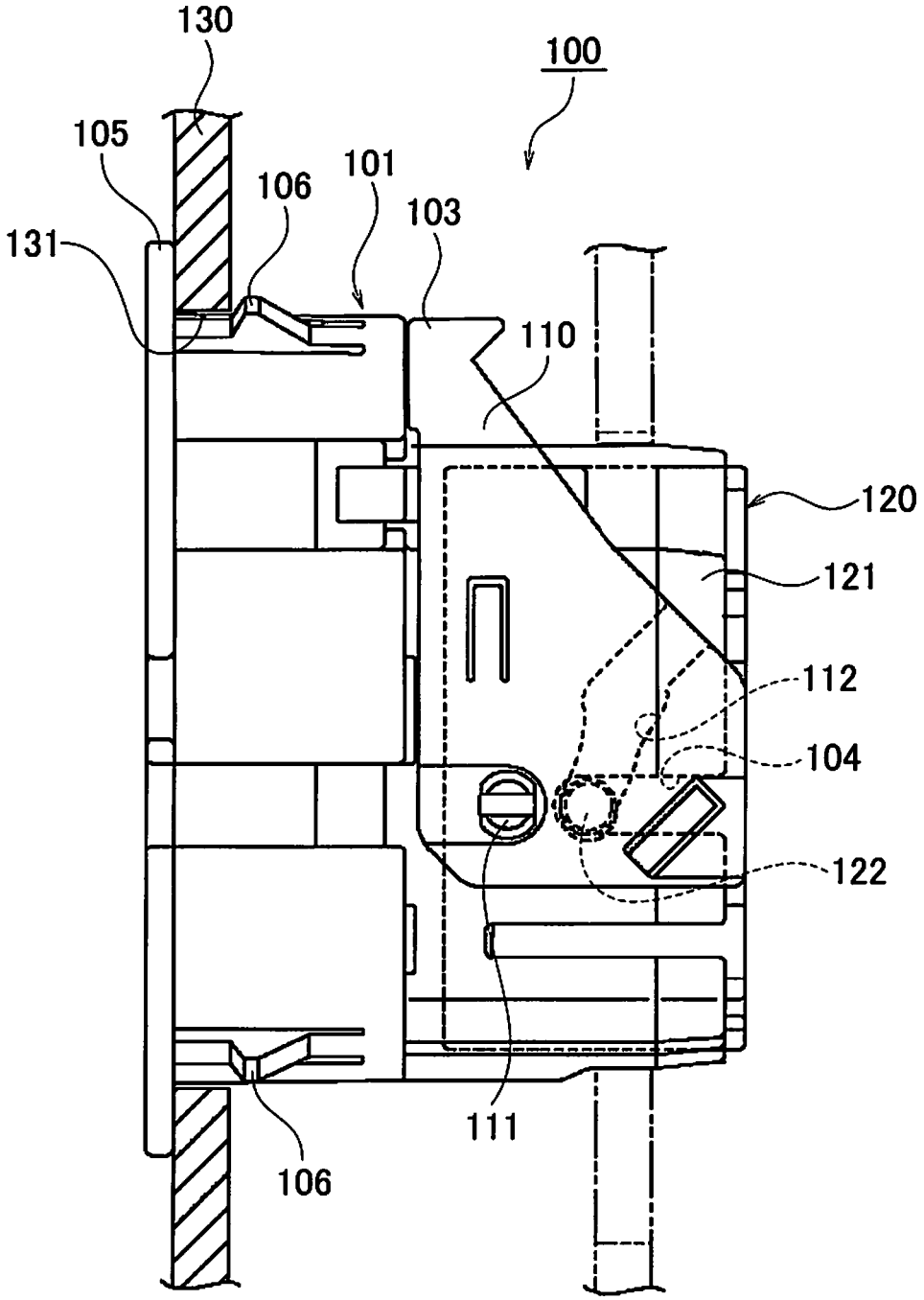
FIG. 3 PRIOR ART
FIG. 3 shows the conventional example and is a side view of a state where the first connector and the second connector are fitted together.
Figure 4:
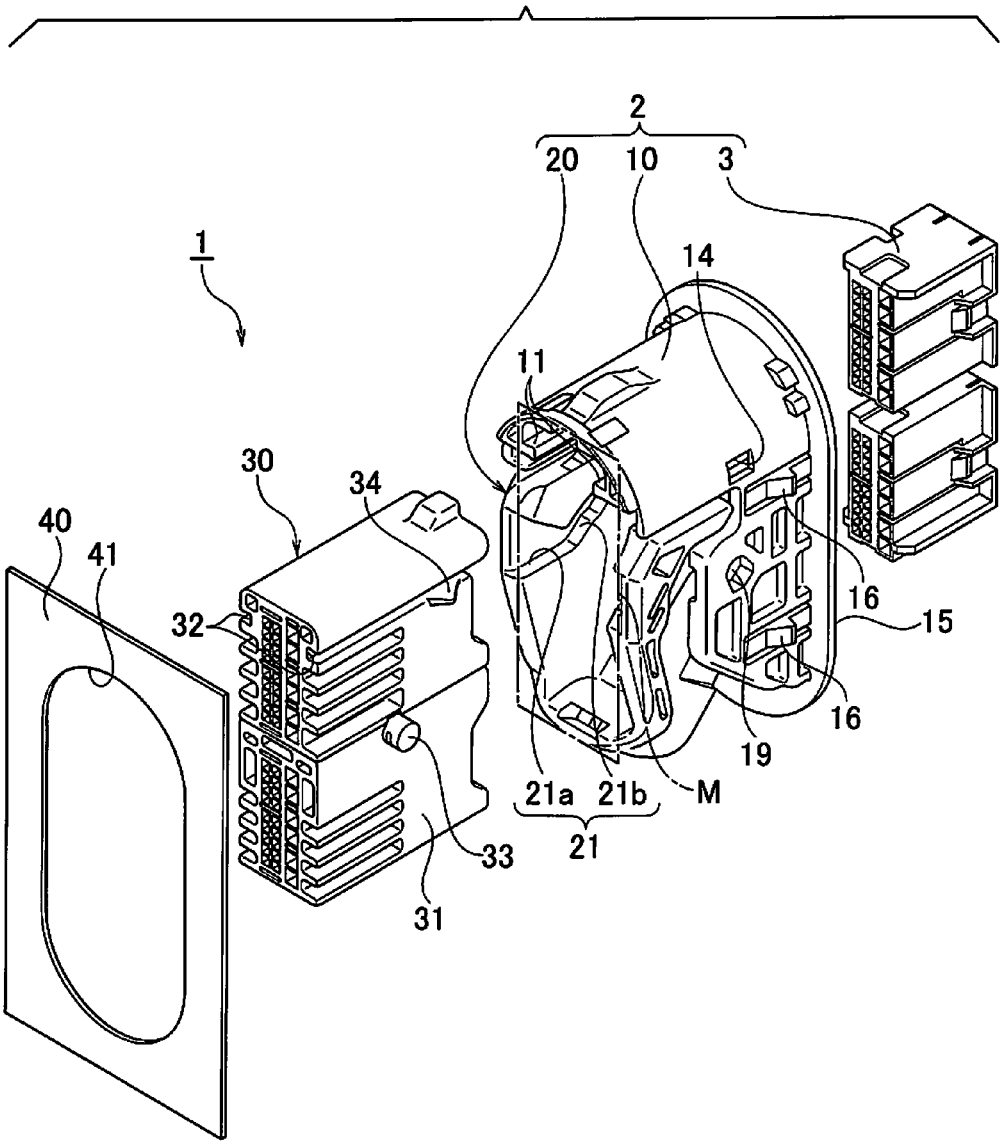
FIG. 4 shows an embodiment of the present invention and is an exploded perspective view of a connector device.
Figure 5:
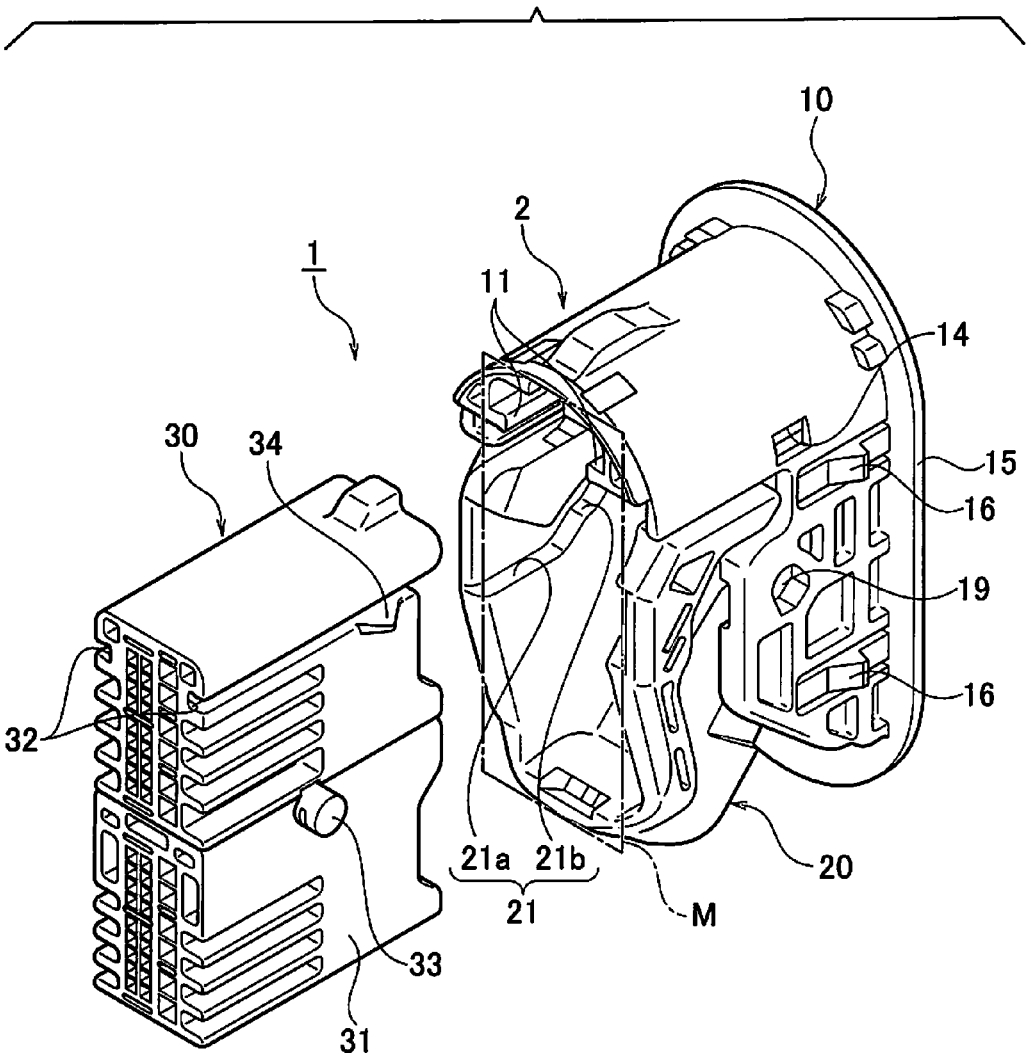
FIG. 5 shows the embodiment of the present invention and is a perspective view of a state before a first connector and a second connector are fitted together.

As shown in FIG. 4 and FIG. 5, a connector device 1 includes a female connector 2 as a first connector and a male connector 30 as a second connector.

The female connector 2 includes a female connector housing 3 as a first connector housing, a frame 10 fixed to the female connector housing 3, and a lever 20 rotatably supported by the frame 10.

The female connector housing 3 is provided with plural male terminals (not shown in the figures) arranged therein. The respective male terminals are connected to end portions of corresponding wires (not shown in the figures).

The frame 10 is provided, on the inner side thereof, with a pair of guide rails 11 serving as connector fitting guide portions. Each guide rail 11 is formed extending in the fitting direction of the male connector 30. The frame 10 is provided, on the inner side thereof, with a pair of lever pre-locking portions 12. Each pre-locking portion 12 (FIG. 7) is formed into an arm-like shape and flexibly deformable. Each pre-locking portion 12 is located at a lever pre-locking position (the virtual line position in FIG. 11) where the movement of the lever 20 located at a fitting start operation position is prevented. Each lever pre-locking portion 12 is shifted, by a pressing force, to a lever pre-locking release position (the solid line position in FIG. 11) where the lever 20 is allowed to move.

A semi-fitting detection portion 13 is attached to each lever pre-locking portion 12 on the tip side. A pair of semi-fitting detection portions 13 are provided to face projection holes 19 of the frame 10. The pair of semi-fitting detection portions 13 are shifted to follow the lever pre-locking portions 12. In other words, the semi-fitting detection portions are located at a non-projecting position (the virtual line position in FIG. 11) where the semi-fitting detections 13 do not project but are placed below the peripheral surface of the frame 10 when the lever pre-locking portions 12 are located at the lever pre-locking position. The semi-fitting detection portions 13 are shifted to a projecting position (the solid line position in FIG. 11) where the semi-fitting detection portions 13 project from the peripheral surface of the frame 10 when the lever pre-locking portions 12 are located at the lever pre-locking release position.

The frame 10 is provided, along the circumference of the rear end thereof, with a locking flange 15. The frame 10 is provided with panel locking portions 16 that project from the peripheral surface of the frame 10. The panel locking projections 16 are elastically deformable to be placed below the peripheral surface of the frame 10 when an external pressing force is applied thereto.

Figure 12:
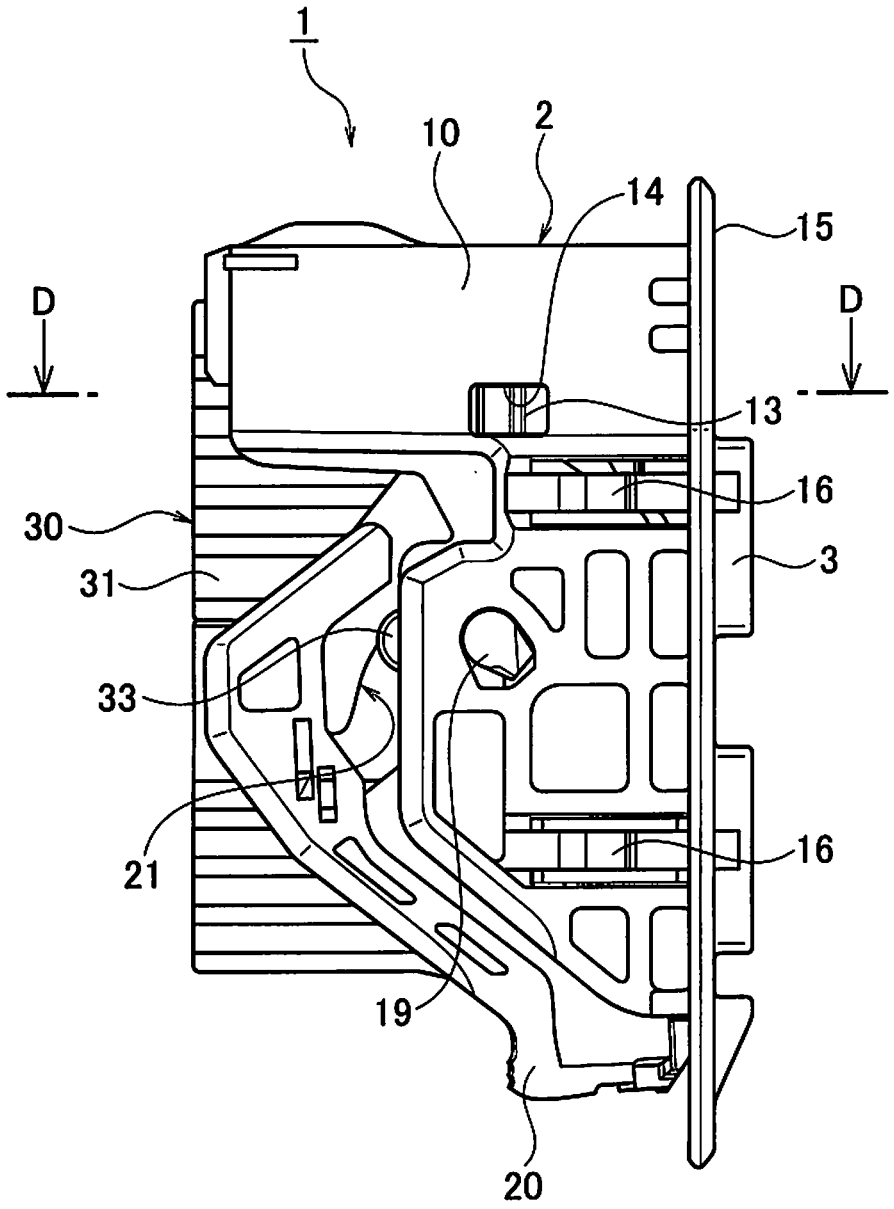
FIG. 12 shows the embodiment of the present invention and is a side view showing a part of the process of fitting the first connector and the second connector together.

The lever 20 rotates about a rotation support 19 within a range from a fitting start operation position (the position shown in FIG. 5) to a fitting end operation position (the position shown in FIG. 12). The lever 20 is provided with lever pre-lock pieces 22 (FIG. 7) located opposite to the operation side of the lever 20 around the rotation support 19. The lever pre-lock pieces 22 are locked when the lever pre-locking portions 12 are located at the pre-locking position so as to prevent the lever 20 from rotating. The lever pre-lock pieces 22 are not locked when the lever pre-locking portions 12 are located at the pre-locking release position so as to allow the lever 20 to rotate. When the lever 20 is located at the fitting start operation position, the lever 20 is provided with a connector fitting front opening M (FIG. 7) common to the frame 10. The lever 20 is provided with a pair of cam grooves 21 on the inner side thereof. Each cam groove 21 includes a tapered inlet groove portion 21*a* and a curved groove portion 21*b* communicating with the inlet groove portion 21*a* and having a gradually-changing distance from the center of the rotation support 19. The inlet groove portion 21*a* is open at the connector fitting front opening M when the lever 20 is located at the fitting start operation position.

The male connector 30 includes a male connector housing 31 as a second connector housing. The male connector housing 31 is provided with plural female terminals (not shown in the figures) arranged therein. The respective female terminals are connected to end portions of corresponding wires (not shown in the figures). The male connector housing 31 is provided with a pair of guide grooves 32 on the outer surface thereof. The guide grooves 32 are formed extending in the fitting direction of the male connector 30. The male connector housing 31 is provided with a pair of cam pins 33 projecting from the outer surface of the male connector housing 31.

The male connector 30 is provided, on the outer surface thereof, with a pair of pressing portions 34 each functioning as both a lever pre-locking release portion and a semi-fitting operation portion. The pair of pressing portions 34 gradually press the lever pre-locking portions 12 in the process of moving to be set at the fitting start position so as to shift the lever pre-locking portions 12 to the lever pre-locking release position when located at the fitting start position. When the pair of pressing portions 34 are located between the fitting start position and the fitting end position, namely, located at a fitting halfway position, the pair of pressing portions 34 press and shift the semi-fitting detection portions 13 to the projecting position. When the pair of pressing portions 34 are located at the fitting end position, the pressure applied to the semi-fitting detection portions 13 is released so that the semi-fitting detection portions 13 are set at the non-projecting position.

Figure 6:
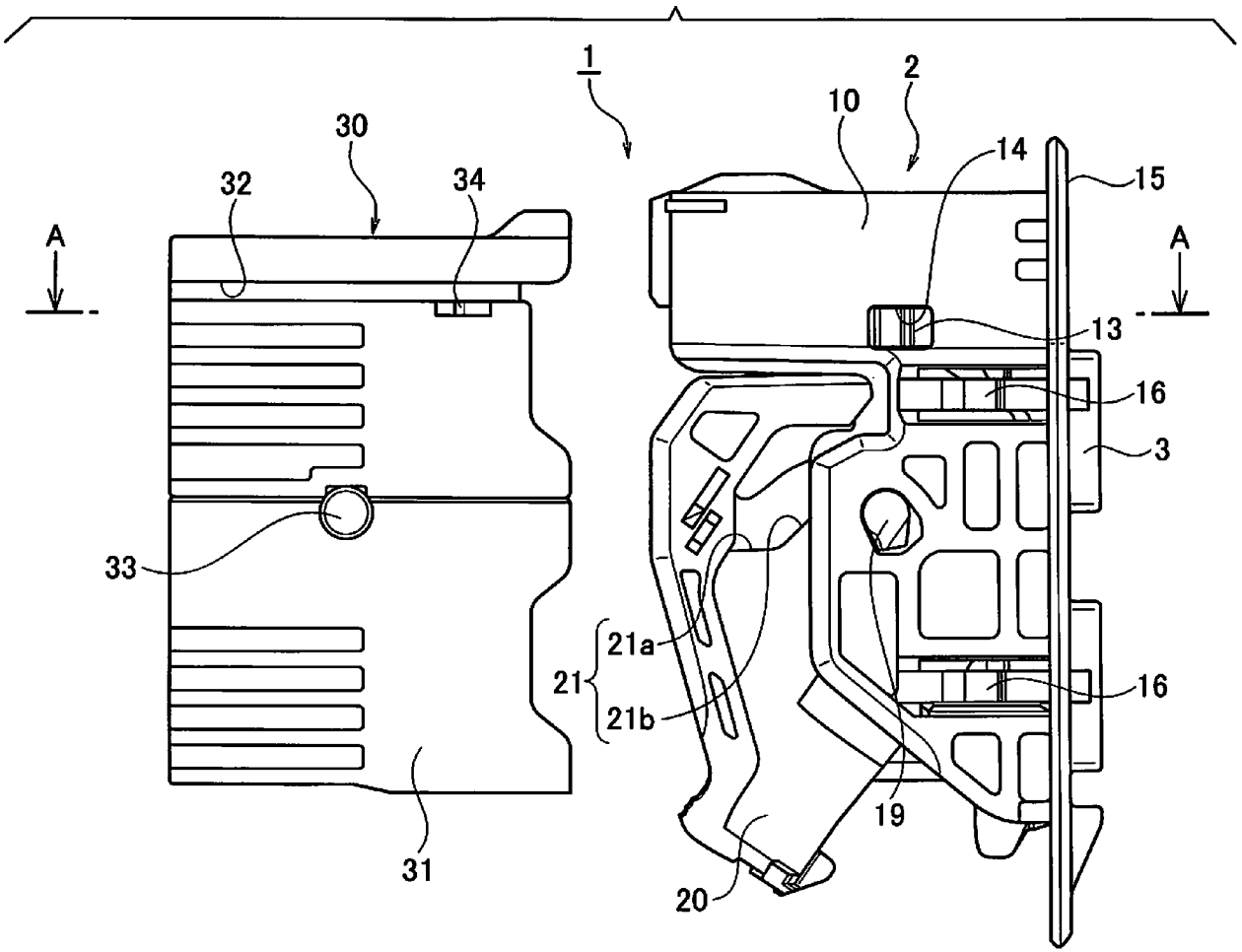
FIG. 6 shows the embodiment of the present invention and is a side view showing a part of a process of fitting the first connector and the second connector together.
Figure 7:
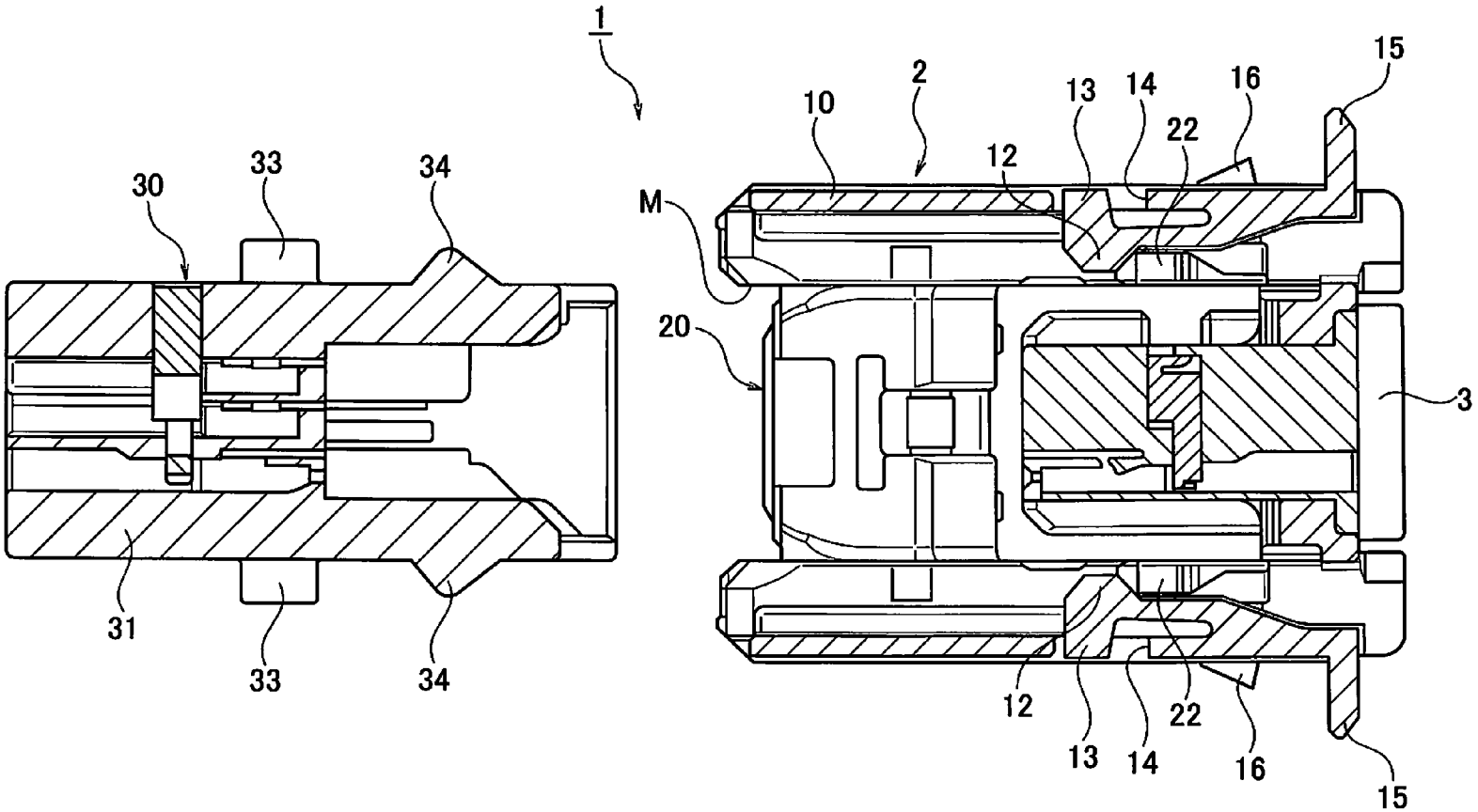
FIG. 7 shows the embodiment of the present invention and is a cross-sectional view along the line A-A in FIG. 6.

Next, the process of fitting the female connector 2 and the male connector 30 together will be described below. As shown in FIG. 6 and FIG. 7, the lever 20 is set at the fitting start operation position with respect to the male connector 30. When the lever pre-locking portions 12 are located at the lover pre-locking position, the lever 20 is pre-locked at the fitting start operation position.

Figure 8:
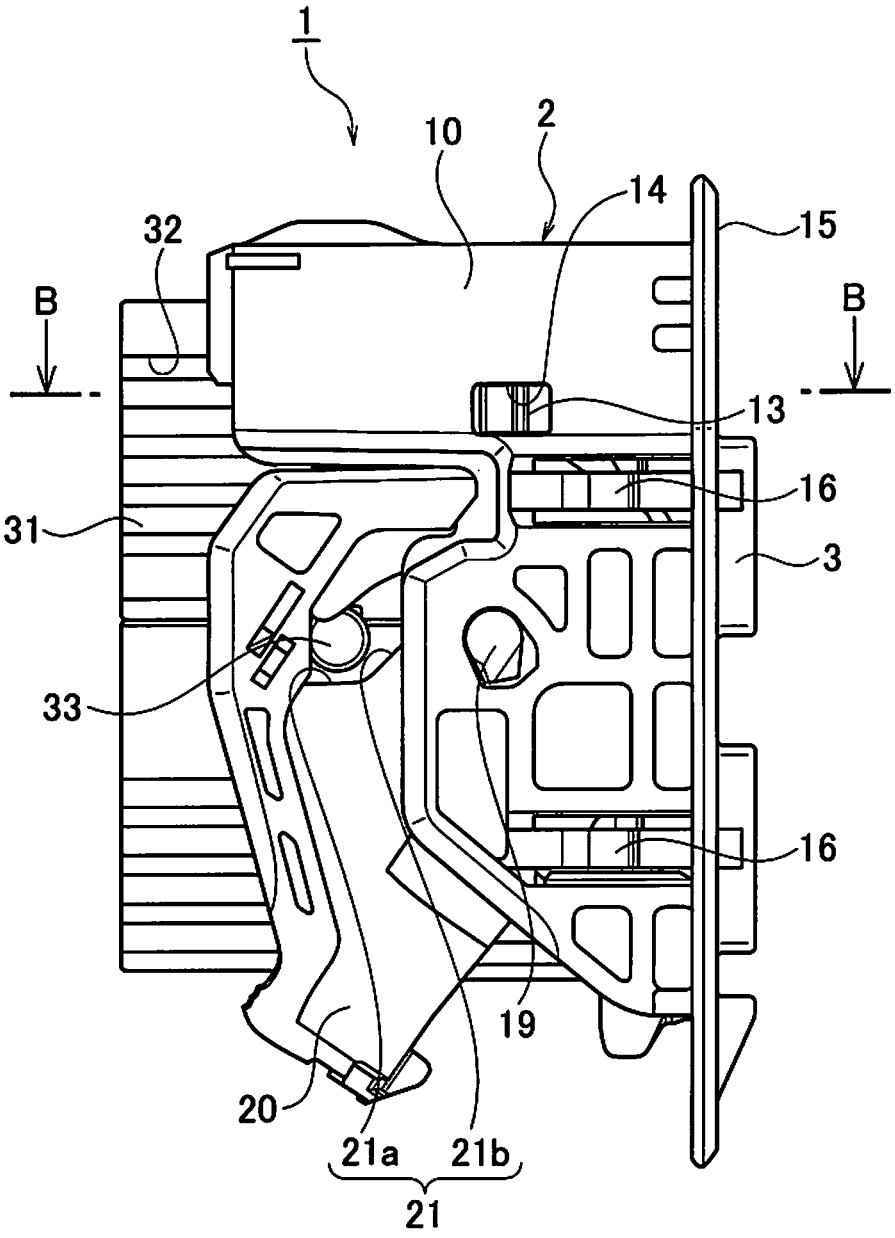
FIG. 8 shows the embodiment of the present invention and is a side view showing a part of the process of fitting the first connector and the second connector together.
Figure 9:
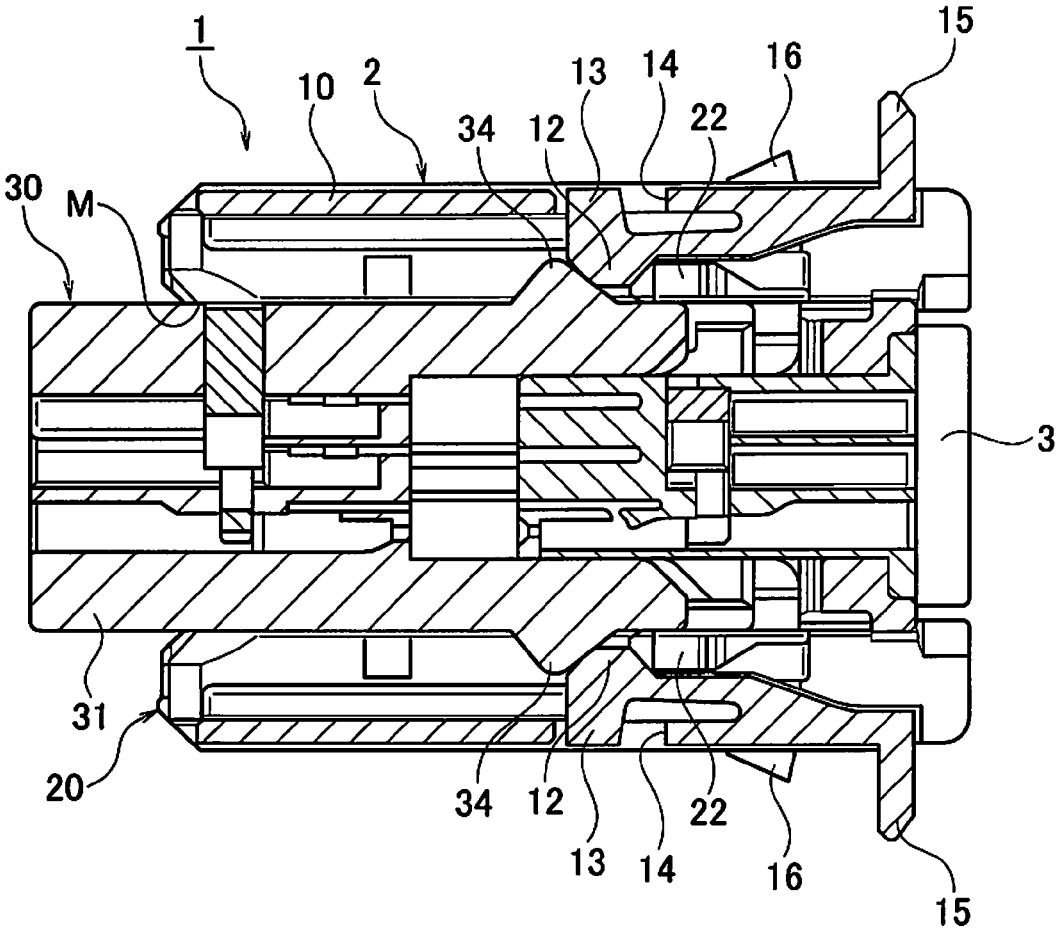
FIG. 9 shows the embodiment of the present invention and is a cross-sectional view along the line B-B in FIG. 8.

The male connector 30 is inserted into the male connector 2 from the connector fitting front opening M which is composed of the lever 20 and the frame 10. The pair of cam pins 33 of the male connector 30 are inserted into the inlet groove portions 21*a* of the respective cam grooves 21. The pair of cam pins 33 are further inserted to the position where the pair of cam pins 33 come into contact with side surfaces of the cam grooves 21. Accordingly, the male connector 30 is set at the fitting start position. In the process of inserting to the fitting start position, as shown in FIG. 8 and FIG. 9, the pressing portions 34 of the male connector 30 come into contact with the lever pre-locking portions 12, so that the lever pre-locking portions 12 are elastically deformed and gradually shifted towards the lever pre-locking release position. At the fitting start position, the lever pre-locking portions 12 are shifted to the lever pre-locking release position. Accordingly, the lever 20 is allowed to rotate.

Figure 10:
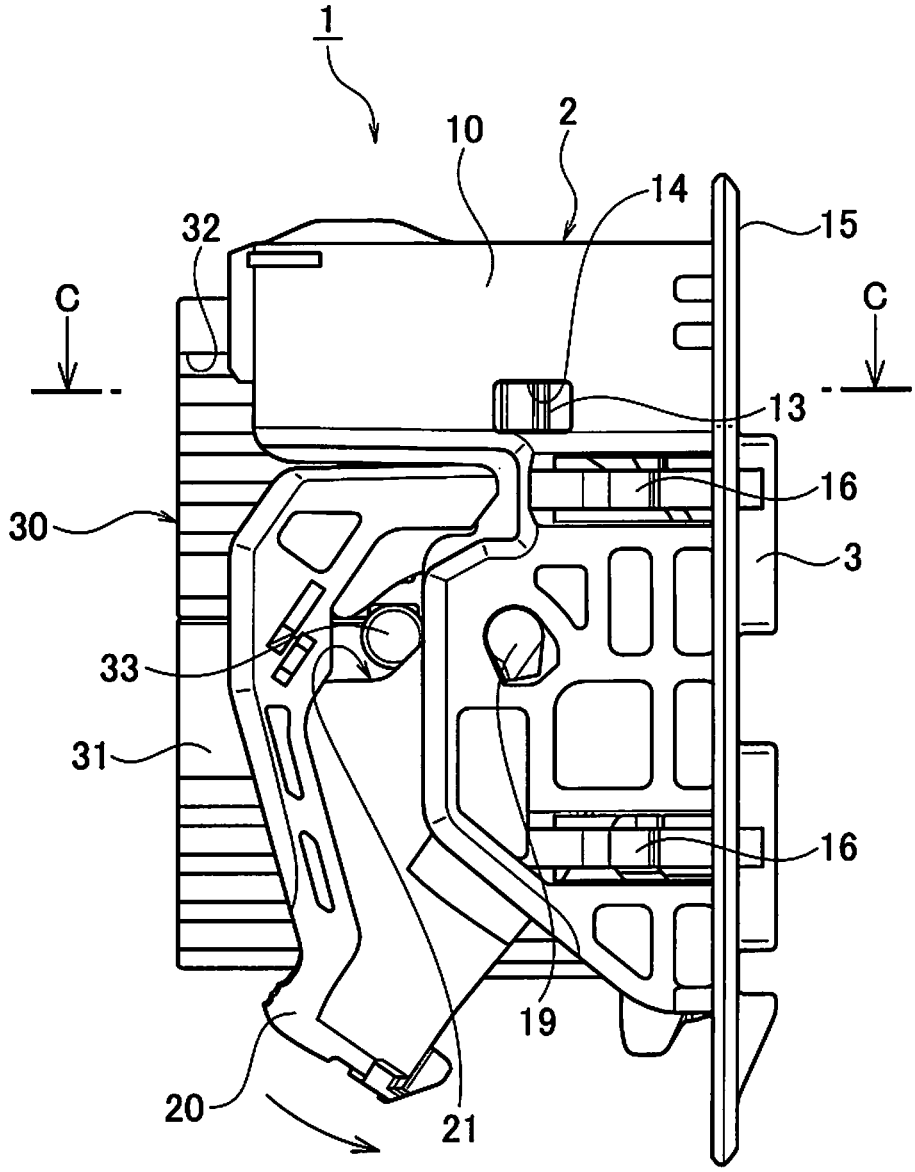
FIG. 10 shows the embodiment of the present invention and is a side view showing a part of the process of fitting the first connector and the second connector together.
Figure 11:
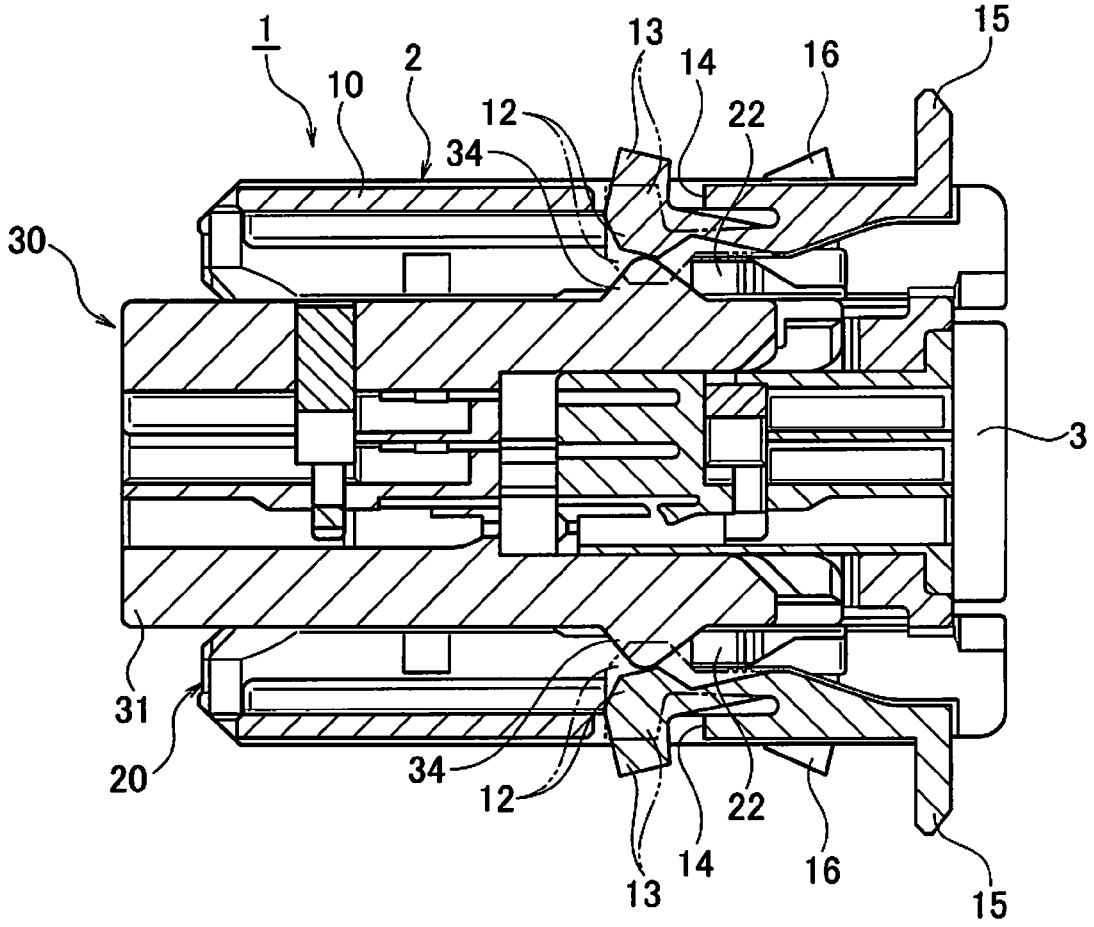
FIG. 11 shows the embodiment of the present invention and is a cross-sectional view along the line C-C in FIG. 10.

Next, as shown in FIG. 10 and FIG. 11, the lever 20 located at the fitting start operation position rotates towards the fitting end operation position. The cam pins 33 then move in the cam grooves 21, and a fitting force acts on both the male connector 30 and the female connector 2 so that the male connector 30 and the female connector 2 are gradually fitted together. At the fitting halfway position, the pressing portions 34 of the male connector 30 keep pressing the lever pre-locking portions 12. Thus, at the fitting halfway position, the semi-fitting detection portions 13 are in the projecting state.

Figure 13:
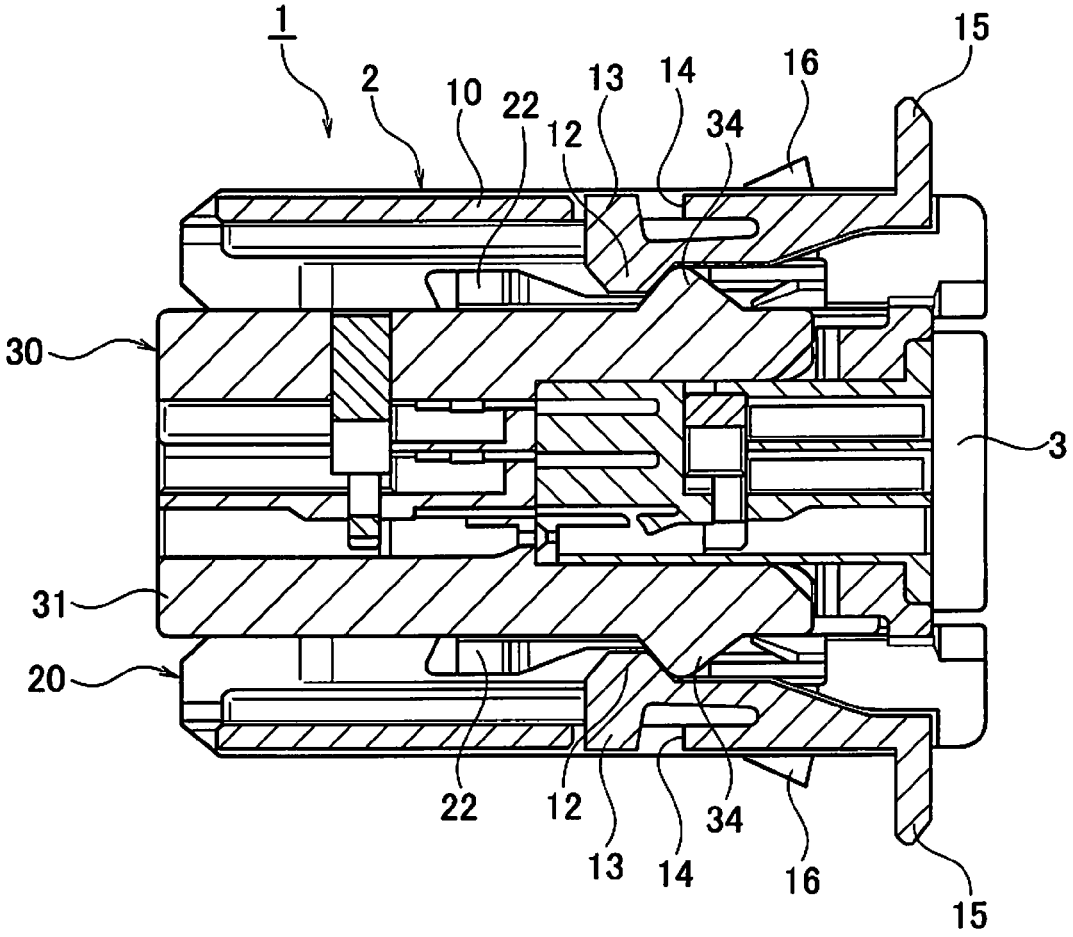
FIG. 13 shows the embodiment of the present invention and is a cross-sectional view along the line D-D in FIG. 12.

When the rotating lever 20 reaches the fitting end operation position, as shown in FIG. 12 and FIG. 13, the male connector 30 and the female connector 2 are fitted together. At the fitting end position, the female terminals (not shown in the figures) and the male terminals (not shown in the figures) corresponding to each other are in a properly connected state. At the fitting end position, the pressing portions 34 of the male connector 30 pass over the lever pre-locking portions 12 so that the pressing force is released. The lever pre-locking portions 12 then return to the non-projecting position due to an elastic recovery force. At the fitting end position, the semi-fitting detection portions 13 are located at the non-projecting position.

Subsequently, the connector device 1 in which the female connector 2 and the male connector 30 are fitted together is inserted into an mounting hole 41 (shown in FIG. 4 and FIGS. 14A and 14B) of a mounting panel 40 (shown in FIG. 4 and FIGS. 14A and 14B) as a mounting member from the frame 10 and lever 20 side.

When the female connector 2 and the male connector 30 are fitted together and located at the fitting end position, namely, the connectors are in a properly fitted state, the panel locking portions 16 come into contact with the peripheral edge of the mounting hole 41. By further applying an insertion force thereto, the panel locking portions 16 are elastically deformed inward so as to allow the frame 10 and the lever 20 to be inserted to the mounting hole 41. Once the panel locking portions 16 completely pass through the mounting hole 41, the panel locking portions 16 are elastically deformed to return to the original state, and the locking flange 15 comes into contact with the mounting panel 40 around the mounting hole 41. Accordingly, the mounting panel 40 is interposed between the respective panel locking portions 16 and the locking flange 15 so that the connector device 1 is mounted to the mounting panel (refer to FIG. 14B).

Figure 14A:
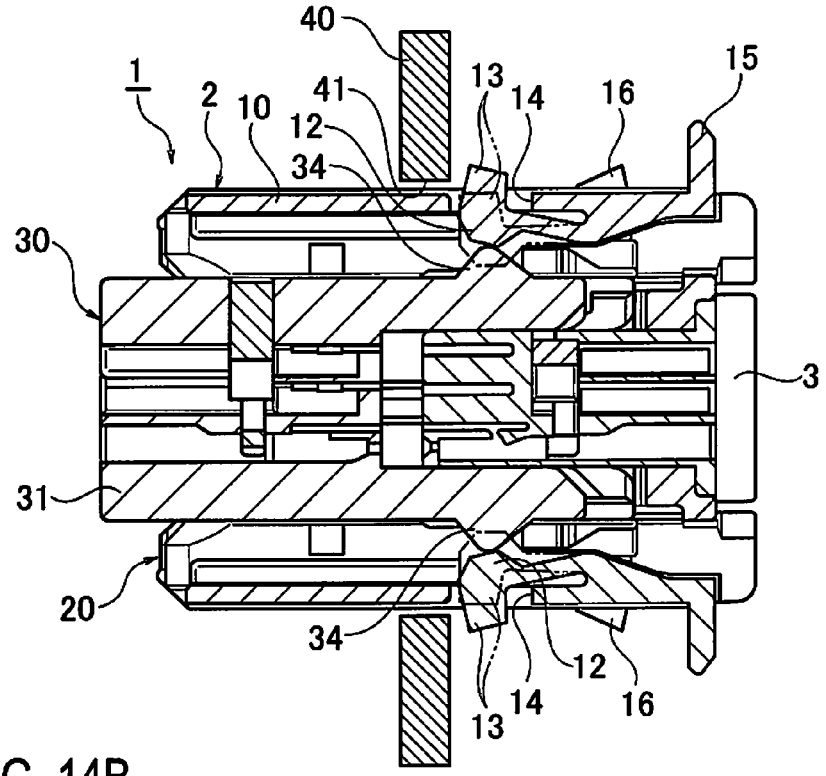
FIG. 14A shows the embodiment of the present invention and is a cross-sectional view showing a state where the connector device in a semi-fitted state is inserted into a mounting hole of a vehicle body panel.
Figure 14B:
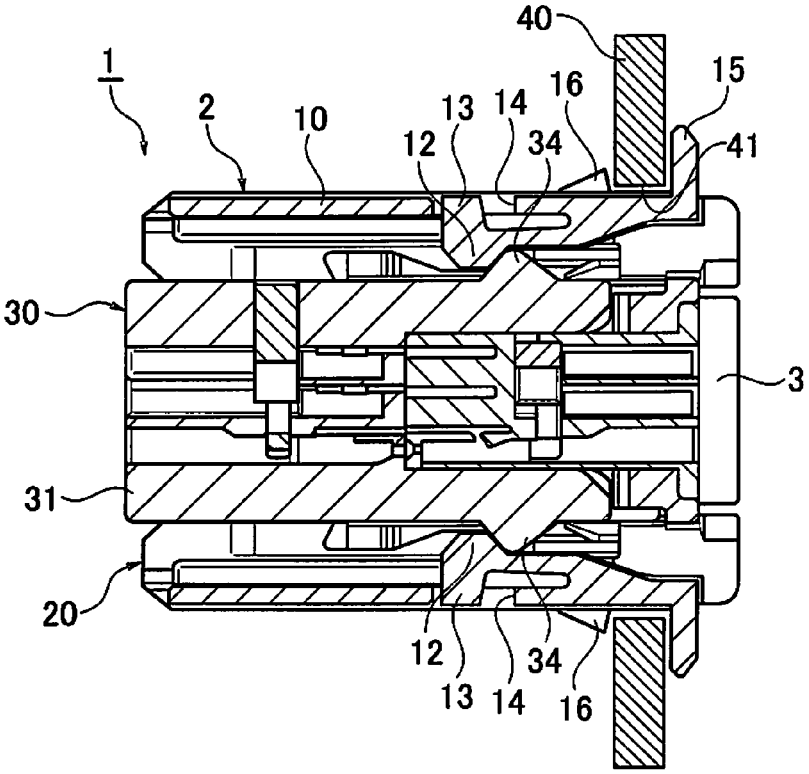
FIG. 14B shows the embodiment of the present invention and is a cross-sectional view showing a state where the connector device in a properly fitted state is inserted into the mounting hole of the vehicle body panel.

If the female connector 2 and the male connector 30 are not completely fitted and do not reach the fitting end position, namely, the connectors are in the semi-fitted state, as shown in FIG. 14A, the semi-fitting detection portions 13 project from the peripheral surface of the frame 10. This does not allow the connector device 1 to be mounted to the mounting panel 40 since the semi-fitting detection portions 13 are in contact with the mounting panel 40.

As described above, in the state where the female connector 2 and the male connector 30 are properly fitted together, the semi-fitting detection portions 13 are located at the non-projecting position, so that the connector device 1 can be mounted to the mounting member since the semi-fitting detection portions 13 do not come into contact with the mounting panel 40 when the frame 10 and the lever 20 are inserted into the mounting hole 41 of the mounting panel 40. On the other hand, if the female connector 2 and the male connector 30 are in the semi-fitted state, the semi-fitting detection portions 13 are located at the projecting position. As a result, the connector device 1 is not allowed to be mounted to the mounting member since the semi-fitting detection portions 13 are in contact with the mounting panel 40 when the frame 10 is inserted into the mounting hole 41 of the mounting panel 40. Due to such a configuration, the semi-fitted state of the connector device 1 can be detected.

Since the connector device 1 in the semi-fitted state is not allowed to be mounted to the mounting panel 40, the attachment of the connector device 1 to the mounting panel 40 in the semi-fitted state can be preliminarily prevented. In addition, since the semi-fitting detection portions 13 project from the peripheral surface of the frame 10 in the semi-fitted state, the operator can also detect the semi-fitted state visually. Namely, the semi-fitted state can be detected before the connector device 1 is mounted to the mounting panel 40.

The semi-fitting detection portions 13 are attached to the lever-pre-locking portions 12, and each pressing portion 34 functions as both the semi-fitting operation portion and the lever pre-locking release portion. Accordingly, a connector device already provided with both the lever pre-locking portions 12 and the lever pre-locking release portions can be changed to the connector device 1 capable of detecting a semi-fitted state, by a simple design change of existing members without adding any new component.

The lever 20 is provided with the connector fitting front opening common to the frame 10 in the state where the lever 20 is located at the fitting start operation position. This avoids a dual structure in which the lever 20 is provided on the outside of the frame 10 as seen in the conventional example. As a result, the connector device 1 having the connector fitting front opening M can achieve a reduction in size.

In the present embodiment, the first connector consists of the female connector 2 and the second connector consists of the male connector 30; however, the first connector may consist of the male connector 30 and the second connector may consist of the female connector 2. In such a case, the frame 10 and the lever 20 are fixed to the male connector 30.

In the present embodiment, the connector fitting guide portions are the guide rails 11, but are not particularly limited thereto. The connector fitting guide portions are only required to guide the male connector 30 in the process of fitting the male connector 30 to the female connector 2. In the case of having a connector fitting chamber, the peripheral wall of the connector fitting chamber serves as a connector fitting guide portion.

What is claimed is:

1. A connector device comprising:

a first connector including a first connector housing provided with a first terminal therein, a frame fixed to the first connector housing and provided with a connector fitting guide portion, and a lever rotatably supported by the frame;

a second connector including a second connector housing provided with a second terminal therein, the second connector housing being guided by the connector fitting guide portion so as to be fitted to the first connector, wherein a fitting force acts on the first connector and the second connector by operating the lever from a fitting start operation position to a fitting end operation position, the second connector moves from a fitting start position to a fitting end position, and the frame is inserted and mounted to a mounting hole of a mounting member in a state where the first connector and the second connector are fitted together;

a semi-fitting detection portion which is located at a non-projecting position below a peripheral surface of the frame of the first connector and is shifted to a projecting position to project from the peripheral surface of the frame by a pressing force; and a semi-fitting operation portion which is provided in the second connector, presses and shifts the semi-fitting detection portion to the projecting position when located at a fitting halfway position before the fitting end position, and stops pressing the semi-fitting detection portion when located at the fitting end position so as to shift the semi-fitting detection portion to the non-projecting position.

2. The connector device according to claim 1, further comprising:

a lever pre-locking portion which is provided in the first connector, is located at a lever pre-locking position where the lever located at the fitting start operation position is prevented from moving, and is shifted, by a pressing force, to a lever pre-locking release position where the lever is allowed to move; and a lever pre-locking release portion which is provided in the second connector, and when set at the fitting start position, presses and shifts the lever pre-locking portion to the lever pre-locking release position, wherein the semi-fitting detection portion is attached to the lever pre-locking portion, and follows the lever pre-locking portion so as to be shifted to the non-projecting position when the lever pre-locking portion is located at the lever pre-locking position and shifted to the projecting position when the lever pre-locking portion is located at the lever pre-locking release position, and a pressing portion functions as both the semi-fitting operation portion and the lever pre-locking release portion.

3. The connector device according to claim 1, wherein the lever is provided with a connector fitting front opening common to the frame in a state where the lever is located at the fitting start operation position.

* * * * *